US011286824B2

(12) United States Patent
Woog et al.

(10) Patent No.: US 11,286,824 B2
(45) Date of Patent: Mar. 29, 2022

(54) METHOD FOR DESULPHURISING A NITROGEN OXIDE ACCUMULATOR CATALYTIC CONVERTER

(71) Applicant: Daimler AG, Stuttgart (DE)

(72) Inventors: Thorsten Woog, Stuttgart (DE); Berthold Keppeler, Owen (DE); Nathalie Janine Schweitzer, Gaertringen (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 17/254,165

(22) PCT Filed: Jun. 6, 2019

(86) PCT No.: PCT/EP2019/064754
§ 371 (c)(1),
(2) Date: Dec. 18, 2020

(87) PCT Pub. No.: WO2019/243065
PCT Pub. Date: Dec. 26, 2019

(65) Prior Publication Data

US 2021/0270166 A1 Sep. 2, 2021

(30) Foreign Application Priority Data

Jun. 20, 2018 (DE) ..... 10 2018 004 892.7

(51) Int. Cl.
*F01N 9/00* (2006.01)
*F01N 3/08* (2006.01)
*F01N 3/20* (2006.01)

(52) U.S. Cl.
CPC ..... *F01N 3/0885* (2013.01); *F01N 3/0814* (2013.01); *F01N 3/0842* (2013.01); (Continued)

(58) Field of Classification Search
CPC ..... F01N 3/0885; F01N 2550/20; F01N 2900/1612
See application file for complete search history.

(56) References Cited

U.S. PATENT DOCUMENTS 6,460,328 B1 10/2002 Hertzberg
2002/0054844 A1 5/2002 Pfeifer et al.
(Continued)

FOREIGN PATENT DOCUMENTS

CN 103237965 A 8/2013
CN 103982279 A 8/2014
(Continued)

OTHER PUBLICATIONS

Machine translation of JP-2009221913-A, accessed Aug. 26, 2021. (Year: 2021).*
(Continued)

*Primary Examiner* — Jonathan R Matthias
(74) *Attorney, Agent, or Firm* — Crowell & Moring LLP

(57) ABSTRACT

A method for desulphurising a nitrogen oxide accumulator catalytic converter of an exhaust gas system that includes the nitrogen oxide accumulator catalytic converter and at least one selective catalytic reduction catalytic converter disposed downstream of the nitrogen oxide accumulator catalytic converter, of an internal combustion engine, where a desulphurisation strategy, on the basis of which the nitrogen oxide accumulator catalytic converter is desulphurised, is adjusted to the ageing of the nitrogen oxide accumulator catalytic converter.

5 Claims, 1 Drawing Sheet

(52) U.S. Cl.
CPC ..... *F01N 3/20* (2013.01); *F01N 2260/04* (2013.01); *F01N 2550/20* (2013.01); *F01N 2900/1612* (2013.01)

(56) References Cited

U.S. PATENT DOCUMENTS

| | | | | |
|---|---|---|---|---|
| 2003/0131591 | A1* | 7/2003 | Pott | F01N 3/0814 60/295 |
| 2013/0318950 | A1 | 12/2013 | Gottwald | |
| 2014/0186220 | A1* | 7/2014 | Sakurai | F01N 3/0814 422/108 |
| 2014/0223902 | A1 | 8/2014 | Yacoub | |
| 2017/0122158 | A1 | 5/2017 | Choung | |

FOREIGN PATENT DOCUMENTS

| | | | | | |
|---|---|---|---|---|---|
| DE | 199 54 549 | A1 | | 5/2001 | |
| DE | 10 2007 060 623 | A1 | | 6/2009 | |
| DE | 10 2016 003 058 | A1 | | 9/2017 | |
| JP | 2008157244 | A | * | 7/2008 | F02D 41/028 |
| JP | 2009221913 | A | * | 10/2009 | |
| KR | 2002-0035445 | A | | 5/2002 | |
| WO | WO 01/44630 | A2 | | 6/2001 | |
| WO | WO 2004/090296 | A1 | | 10/2004 | |

OTHER PUBLICATIONS

PCT/EP2019/064754, International Search Report dated Dec. 17, 2019 (Three (3) pages).

Chinese-language Office Action issued in Chinese Application No. 201980040691.9 dated Nov. 26, 2021 with English translation (12 pages).

* cited by examiner

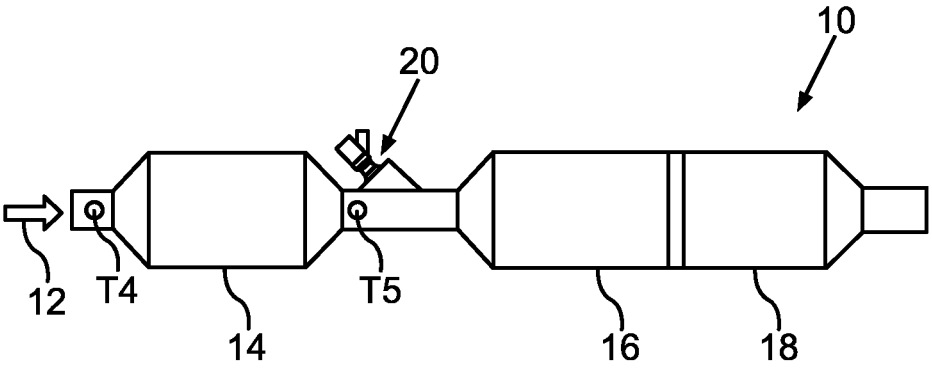
10
20
12
T4
T5
14
16
18

METHOD FOR DESULPHURISING A NITROGEN OXIDE ACCUMULATOR CATALYTIC CONVERTER

BACKGROUND AND SUMMARY OF THE INVENTION

DE 10 2016 003 058 A1 discloses a diesel combustion engine for a car, having an exhaust gas post-treatment device that can be flowed through by exhaust gas from the diesel combustion engine. The exhaust gas post-treatment device has at least one nitrogen oxide accumulator catalytic converter, having a catalytic converter volume, for accumulating nitrogen oxides from the exhaust gas, a particulate filter arranged downstream of the nitrogen oxide accumulator catalytic converter in relation to the flow direction of the exhaust gas through the exhaust gas post-treatment device, and a selective catalytic reduction (SCR) catalytic converter arranged downstream of the particulate filter. Here, the accumulation material of the nitrogen oxide accumulator catalytic converter is formed from rare-earth compounds.

Moreover, a method for operating an exhaust gas purification system having a nitrogen oxide adsorber is known from DE 199 54 549 A1.

The object of the present invention is to create a method by means of which a nitrogen oxide accumulator catalytic converter, in particular of a car, can be desulphurised particularly advantageously.

In the method according to the invention for desulphurising a nitrogen oxide accumulator catalytic converter, also referred to as an NSK, of an exhaust gas system, comprising the nitrogen oxide accumulator catalytic converter and at least one SCR catalytic converter arranged downstream of the nitrogen oxide accumulator catalytic converter, of an internal combustion engine, in particular of a diesel engine, a desulphurisation strategy, on the basis of which the nitrogen oxide accumulator catalytic converter is desulphurised, is adjusted to an ageing of the nitrogen oxide accumulator catalytic converter. Desulphurising the nitrogen oxide accumulator catalytic converter is to be understood, in particular, to mean that nitrogen accumulated in the nitrogen oxide accumulator catalytic converter, the nitrogen having been received and accumulated by the nitrogen oxide accumulator catalytic converter out of the exhaust gas of the internal combustion engine, is at least or only partially removed from the nitrogen oxide accumulator catalytic converter. The method according to the invention is an operating strategy for operating the nitrogen oxide accumulator catalytic converter, such that a ratio of nitrogen dioxide (NO2) and nitrogen oxide (NOx) can be achieved at an output of the nitrogen oxide accumulator catalytic converter, the ratio being 50 percent or as close to 50 percent as possible. The background to the invention is that a quick SCR reaction in the SCR catalytic converter arranged downstream of the NSK preferably proceeds when the ratio of NO2 to NOx is about 50 percent.

Here, it is provided that the desulphurisation strategy is adjusted to the ageing of the nitrogen oxide accumulator catalytic converter in such a way that respective time intervals, which lie between two desulphurisation processes for desulphurising the nitrogen oxide accumulator catalytic converter, become longer as the ageing of the nitrogen oxide accumulator catalytic converter increases.

In an advantageous design of the invention, it is provided that the nitrogen oxide accumulator catalytic converter is formed as a nitrogen oxide accumulator catalytic converter having cryogenic accumulator capability and as an oxidation catalytic converter, in particular as a diesel oxidation catalytic converter.

In an advantageous design of the invention, it is provided that the desulphurisation strategy is adjusted to the ageing of the nitrogen oxide accumulator catalytic converter in such a way that respective desulphurisation phases during a desulphurisation process for desulphurising the nitrogen oxide accumulator catalytic converter become shorter as the ageing of the nitrogen oxide accumulator catalytic converter increases. In the scope of the invention, a desulphurisation process is to be understood to mean a process which has one or more desulphurisation phases, wherein a desulphurisation phase is to be understood as a rich phase. In the scope of the invention, a rich phase is here to be understood as a period of time in which the internal combustion engine is operated with a rich combustion mixture setting. Advantageously, the desulphurisation phases are each alternately interrupted by lean phases. Lean phases are to be understood as periods of time in which the internal combustion engine is operated with a lean combustion mixture setting.

In an advantageous design of the invention, it is provided that the desulphurisation strategy is adjusted to the ageing of the nitrogen oxide accumulator catalytic converter in such a way that the number of the respective desulphurisation phases during a desulphurisation process to desulphurise the nitrogen oxide accumulator catalytic converter is reduced as the ageing of the nitrogen oxide accumulator catalytic converter increases.

In an advantageous design of the invention, it is provided that the desulphurisation strategy is adjusted to the ageing of the nitrogen oxide accumulator catalytic converter in such a way that respective desulphurisation temperatures at which respective desulphurisation processes are carried out to desulphurise the nitrogen oxide accumulator catalytic converter become lower as the ageing of the nitrogen oxide accumulator catalytic converter increases.

In an advantageous design of the invention, it is provided that the ageing of the nitrogen oxide accumulator catalytic converter is calculated based on at least one calculation model by means of an electronic calculating device.

Preferably, the nitrogen oxide accumulator catalytic converter is formed as a so-called DOC-plus catalytic converter, which is also referred to as the DOC-plus. The DOC-plus is an NSK with cryogenic accumulator capability which can be achieved by cerium (Ce), in particular. The DOC-plus thus comprises an accumulator material, for example, for receiving and accumulating nitrogen oxides from the exhaust gas, wherein the accumulator material has at least, in particular at least extensively, Ce. Such an NSK with cryogenic accumulator capability is also referred to as NSK-light Moreover, the DOC-plus is formed as a diesel oxidation catalytic converter (DOC), such that the DOC-plus has a diesel oxidation catalytic converter function (DOC function). Thus, as part of its DOC function, the DOC-plus is formed to oxidize nitric oxide (NO) to form nitrogen dioxide (NO2) on its noble metal coating. However, it has been found that the capability of the DOC-plus to oxidize nitric oxide to form nitrogen dioxide, also referred to as the oxidation capability, decreases with increasing age or with increasing ageing.

Moreover, the DOC-plus has an accumulator function, as part of which nitrogen oxides, in particular nitric oxide, from the exhaust gas of the internal combustion engine are stored in the DOC-plus, in particular in its accumulator material. Because of the temperature accumulator capability, nitric oxides and nitrogen dioxides are stored more quickly at low temperatures than nitric oxide is oxidized. As part of a poisoning of the NSK, it can result in sulphur entry into the nitrogen oxide accumulator catalytic converter, in particular into its accumulator material, such that sulphur, which can be contained in the exhaust gas, for example, claims or takes away accumulator spaces which are actually provided for accumulating nitrogen oxides, in particular nitrogen dioxides. As part of the desulphurisation, sulphur is removed from the nitrogen oxide accumulator catalytic converter in order to create accumulator capability for accumulating nitrogen oxides from the exhaust gas.

The desulphurising also referred to as desulphurisation of the nitrogen oxide accumulator catalytic converter takes place as part of a respective desulphurisation process, which is carried out on the basis of the desulphurisation strategy. As part of the method according to the invention, it is provided by way of example that the respective desulphurisation process for the aged nitrogen oxide accumulator catalytic converter is carried out in such a way and time intervals also referred to as desulphurisation intervals are determined or set in such a way that only an incomplete desulphurisation of the nitrogen oxide accumulator catalytic converter takes place. Thus, the rest of the sulphur content remaining in the nitrogen oxide accumulator catalytic converter, in particular in its accumulator material, is consciously maintained, such that after the respective desulphurisation process, sulphur is still stored in the nitrogen oxide accumulator catalytic converter, in particular in its accumulator material. The respective desulphurisation process here lies between two temporally successive desulphurisation processes, wherein carrying out a desulphurisation process to desulphurise the nitrogen oxide accumulator catalytic converter during the desulphurisation process (time interval) is omitted.

The exhaust gas system and thus the nitrogen oxide accumulator catalytic converter and the SCR catalytic converter are preferably arranged close to the engine. Thus, the exhaust gas system and the SCR catalytic converter and the nitrogen oxide accumulator catalytic converter are preferably not arranged roughly below or in the region of an underbody of the motor vehicle, but rather in an engine chamber of the motor vehicle, in the motor chamber of which the internal combustion engine is arranged.

While a desulphurisation process is carried out every 3000 to 4000 kilometers when the nitrogen oxide accumulator catalytic converter is new, for example, the desulphurisation interval is longer with an aged nitrogen oxide accumulator catalytic converter. While a desulphurisation process lasts 8 to 10 seconds when the nitrogen oxide accumulator catalytic converter is new, for example, the desulphurisation process lasts 5 to 8 seconds with an aged nitrogen oxide accumulator catalytic converter. While the respective desulphurisation process is carried out at a temperature of at least substantially 600 degrees Celsius when the nitrogen oxide accumulator catalytic converter is new, for example, the respective desulphurisation process is carried out at least substantially 570 degrees Celsius with an aged nitrogen oxide accumulator catalytic converter.

The ageing of the nitrogen oxide accumulator catalytic converter can be ascertained by means of model calculations. From these, a current remaining sulphur content can be determined with a current desulphurisation strategy, whereupon, if necessary, the desulphurisation strategy can then be adapted.

The feature that the nitrogen oxide accumulator catalytic converter is aged is to be understood to mean that the nitrogen oxide accumulator catalytic converter has, for example, a mileage ranging from about 160000 kilometers to 200000 kilometers, in particular with normal or average driving operation. Further definitions of the feature "aged" can be seen in DE 10 2016 003 058 A1, for example.

Further advantages, features and details of the invention emerge from the below description of a preferred exemplary embodiment and by means of the drawing. The features and feature combinations mentioned above in the description and the features and feature combinations mentioned below in the description of the FIGURE and/or shown individually in the single FIGURE can not only be used in the respectively stated combination, but also in other combinations or on their own without leaving the scope of the invention.

BRIEF DESCRIPTION OF THE DRAWING

In the single FIGURE, the drawing shows a schematic depiction of an exhaust gas system for an internal combustion engine, in particular for a diesel combustion engine, of a motor vehicle.

DETAILED DESCRIPTION OF THE DRAWING

In a schematic depiction, the single FIGURE shows an exhaust gas system 10 for an internal combustion engine, not depicted in the FIGURE, of a motor vehicle, in particular a utility motor vehicle. The internal combustion engine is preferably formed as a diesel combustion engine or as a diesel engine, wherein the motor vehicle can be driven by means of the internal combustion engine. During its fired operation, the internal combustion engine provides exhaust gas which can flow through the exhaust gas system 10. In the FIGURE, an arrow 12 shows the exhaust gas flowing into the exhaust gas system 10 and the exhaust gas flowing through the exhaust gas system 10.

The exhaust gas system 10 has a nitrogen oxide accumulator catalytic converter 14, also referred to as an NSK, by means of which nitrogen oxides potentially contained in the exhaust gas can be received and accumulated. To do so, the NSK has an accumulator material in which nitrogen oxides from the exhaust gas can be stored. Here, the NSK has an entry point via which the exhaust gas can flow into the NSK. Furthermore, the NSK that the exhaust gas can flow through can have an exit point at which the exhaust gas can flow out of the NSK. In particular, the NSK is formed as a DOC-plus, such that the NSK can also work or function as an oxidation catalytic converter, in particular as a diesel oxidation catalytic converter.

A particulate filter 16 is arranged downstream of the NSK in the flow direction of the exhaust gas flowing through the exhaust gas system 10, by means of which particulate filter particles potentially contained in the exhaust gas, in particular carbon black particles, can be filtered out of the exhaust gas. Moreover, an SCR catalytic converter 18 is provided downstream of the NSK. The exhaust gas system 10 thus comprises the NSK, the optionally provided particulate filter 16 and the SCR catalytic converter 18, which is arranged downstream of the NSK (nitrogen oxide accumulator catalytic converter 14) in the flow direction of the exhaust gas flowing through the exhaust gas system 10. The particulate filter 16 and the SCR catalytic converter 18 can thus also be flowed through by the exhaust gas.

Moreover, a dosing device 20 is provided by means of which an in particular liquid reductant can be introduced, in particular injected, into the exhaust gas to denitrify the exhaust gas. To do so, the reductant can be introduced into the exhaust gas by means of the dosing device 20 at a point, wherein the point is arranged downstream of the nitrogen oxide accumulator catalytic converter 14 and upstream of the SCR catalytic convert 18, in particular upstream of the particulate filter 16, in the flow direction of the exhaust gas flowing through the exhaust gas system 10. The SCR catalytic converter 18 is formed for catalytically supporting or effectuating a selective catalytic reduction (SCR), wherein, as part of the SCR, nitrogen oxides potentially contained in the exhaust gas react with ammonia from the reductant to form nitrogen and water. In doing so, the exhaust gas is denitrified. In the exemplary embodiment illustrated in the FIGURE, the SCR catalytic converter is arranged downstream of the particulate filter 16. Moreover, a first temperature sensor T4 is provided by means of which a temperature of the exhaust gas prevailing downstream of the NSK can be recorded. Furthermore, the exhaust gas system 10 comprises a second temperature sensor T5 by means of which a second temperature of the exhaust gas prevailing downstream of the NSK can be recorded.

A method for desulphurising the nitrogen oxide accumulator catalytic converter 14 is described below. In the method, a desulphurisation strategy, on the basis of which the nitrogen oxide accumulator catalytic converter 14 is desulphurised, is adjusted to an ageing of the nitrogen oxide accumulator catalytic converter 14. This is based on the following understanding:

current emission guidelines provide a clear limit of engine emissions, in particular the hydrocarbon (HC), carbon monoxide (CO) and nitrogen oxide (NOx) emissions as well as the particulate (PM) emissions. At the same time, because of increasing fuel consumption economy, the exhaust gas temperatures for the catalytic exhaust gas post-treatment keep on declining. SCR systems near to the engine with a particulate filter with integrated SCR coating (SDPF) and directly subsequent SCR catalytic converter thus play an important role in exhaust gas post-treatment concepts in order to be able to tackle the increased requirements. The particulate filter 16 is thus preferably formed as a diesel particulate filter (DPF) and preferably as an SDPF. The selective catalytic reduction (SCR) is an exceptionally effective method for converting nitrogen oxides back into nitrogen (N2) and water (H2O). For the reduction, the presence of ammoniac (NH3) is required as well as a temperature above 150 degrees Celsius, ideally between 250 degrees Celsius to 450 degree Celsius. The nitrogen oxide conversion is carried out according to the following reaction equations (1) to (4):

$$4NH_3+4NO+O_2 \rightarrow 4N_2+6H_2O \quad (1)$$

$$4NH_3+6NO \rightarrow 5N_2+6H_2O \quad (2)$$

$$4NH_3+2NO+2NO_2 \rightarrow 4N_2+6H_2O \quad (3)$$

$$8NH_3+6NO_2 \rightarrow 7N_2+12H_2O \quad (4)$$

The standard SCR reaction according to (1) contributes the largest amount to the nitrogen oxide conversion. The reaction (2) does convert more nitric oxide with the same NH3 consumption, yet clearly takes longer. If NO and NO2 are present in the exhaust gas in equal proportions, the reaction according to equation (3) takes place more intensely. This has a higher reaction speed than the reaction according to equation (1) and is therefore referred to as a quick SCR reaction. If the amount of nitrogen dioxide is too high, the reaction according to equation (4) takes place instead, in which NH3 and NO2 are converted very slowly. As a result of this, the nitrogen oxide conversion decreases, while the consumption of ammoniac increases. Thus, different NO2/NOx ratios have an impact on the nitrogen oxide conversion. It has been found that the quick SCR reaction takes place at best or most effectively or most quickly with an NO2/NOx ratio of about 50 percent. Catalytic converters such as a diesel oxidation catalytic converter (DOC) or a DOC with cryogenic nitrogen oxide accumulator capacity (DOC-plus) have a functional coating which, along with the oxidation of HC and CO emissions, also has the target of the formation of NO2 taking place according to the following equation (5):

$$NO+\tfrac{1}{2}O_2 \rightarrow NO_2 \quad (5)$$

For the DOC-plus, it should be noted that NO2 is forwarded to the subsequent SCR system only after filling the nitrogen oxide accumulator completely, while the storage of the nitrogen oxides as nitrite or nitrate according to the following equations (6) and (7) is carried out in advance in competition with the NO2 formation. Finally, the DOC-plus displays a NO2 behaviour similar to that of the DOC, wherein the NO2 level for both technologies is greatly dependent on the coating:

$$3NO+2O_2+CeO_2 \rightarrow Ce(NO_3)_3 \quad (6)$$

$$3NO+\tfrac{1}{2}O_2+CeO_2 \rightarrow Ce(NO_2)_3 \quad (7)$$

In order to lie in an optimum range for the quick SCR reaction, an NO2/NOx amount between 35 percent to 65 percent, ideally 50 percent, is desirable. If the NO2 content of NOx is in the greatly aged or poisoned state of the nitrogen oxide accumulator catalytic converter 14, i.e., the DOC-plus or the DOC, is below 40 percent, the SCR conversion markedly decreases. However, if the amount is too high, which occurs in particular in the fresh state of the components, the reaction according to equation (4) is instead carried out which leads to a clear efficiency reduction. The target is thus a defined operating mode or operating strategy, which according to the nitrogen oxide accumulator catalytic converter 14 (DOC-plus or DOC) ensures an optimum NO2/NOx ratio for the SCR system over the entire lifetime of the components or the exhaust gas system 10.

Thus, an exhaust gas treatment system is considered which for example has the nitrogen oxide accumulator catalytic converter 14 and the downstream SCR catalytic converter 18 close to the engine. Over their lifetime, the components are subjected to different thermal loads. This consequently leads to an irreversible ageing of the nitrogen oxide accumulator catalytic converter 14. Here, the NO2 formation decreases with increasing ageing.

In addition, the formation of NO2 according to equation (5) is greatly dependent on the temperature in the nitrogen oxide accumulator catalytic converter 14. The NO2/NOx amount is highest in the region of about 300 degrees Celsius; virtually no NO2 formation takes place below 200 degrees Celsius or above 400 degrees Celsius. If the increase of the NO2/NOx amount cannot be obtained in a different manner, the temperature can be deliberately increased, yet this does involves a clear fuel overconsumption.

Along with the ageing and the operating temperature, there is a series of reversible processes, which influence the NO2/NOx ratio differently. For the DOC-plus and the DOC, this includes the poisoning by stored M. The DOC-plus additionally stores NOx, yet also sulphur (S) on its surface, which also influences the NO2 formation. In addition, the DOC-plus displays a reversible activation behaviour, which can be understood as surface activity. This behaviour also has an impact on the NO2/NOx amount. Thus, in particular, the following influences on the NO2/NOx ratio exist:

Ageing state
Catalytic converter temperature
HC poisoning
Activation degree
NOx accumulator amount
Sulphur poisoning The activation degree, the NOx accumulator amount and sulphur poisoning only relate to the DOC-plus and do not have any significance for the DOC.

Overall, the influences mentioned above and also referred to as mechanisms all take part in the formation of NO2 on the DOC-plus or on the DOC and thus the NOx conversion rendered indirectly via the SCR system. The factors themselves can partly be influenced by a corresponding conditioning of the nitrogen oxide accumulator catalytic converter 14 which enables a regulation of the NO2 level before the SCR system. The different possibilities for NO2 influence by means of suitable conditioning are depicted below for the individual mechanisms finally the overall potential for NO2 regulation is displayed.

The HC poisoning occurs as a result of HC stored on the nitrogen oxide accumulator catalytic converter 14 and negatively impacts the CO conversion and the NO2 formation. The higher the stored HC amount, the greater the poisoning effect. Here, the accumulator capabilities for HC greatly depend on the temperature. With low temperatures below 200 degrees Celsius before the nitrogen oxide accumulator catalytic converter 14, the HC storage is greatest, while from 300 degrees Celsius before the nitrogen oxide accumulator catalytic converter 14, HC storage and thus poisoning no longer occur. The storage of HC, in particular in the nitrogen oxide accumulator catalytic converter 14, is reversible; because of the temperature dependency of the HC accumulator mentioned above, a regeneration can take place by means of temperature increase, for example by means of a richness leap.

Because of its special properties, further influential factors on the NO2 formation emerge on the DOC-plus in comparison to the DOC. The DOC-plus can store NOx in the lean operation and then convert under rich conditions or thermally desorb with lean conditions. A further influential parameter on the NO2 formation on the DOC-plus is consequently the stored NOx accumulator amount, wherein the maximum NOx accumulator amount depends on the ageing state and the coating technology. If the NOx accumulator filling level is low, NO2 is mainly stored on the catalytic converter surface instead of reaching the following SCR system. Only when the NOx accumulator is relatively full, high NO2/NOx ratios are obtained.

In comparison to the DOC, the DOC-plus additionally has a particular behaviour in comparison to short rich exhaust gas compositions, which is referred to as the activation behaviour. Mechanisms such as the so-called Strong Metal Support Interaction (SMSI) and the oxidation of platinum (Pt) provide for the redispersal of the active components (Pt and Pd) on the so-called Wash Coat surface during a richness leap. This activated state stops for a certain period of time under lean conditions and is characterised by an improved CO and HC conversion and enhanced NO2 formation. Thus there is a correlation between the activation state of the DOC-plus and the NO2/NOx amount or ratio. With a fresh and activated nitrogen oxide accumulator catalytic converter 14, higher NO2/NOx ratios are obtained than with deactivated and a greatly aged nitrogen oxide accumulator catalytic converter 14.

While the storage of HC on the catalytic converter surface leads to a deterioration of NO2 formation, the sulphur poisoning occurring on the DOC-plus causes a decrease of the NOx accumulator amount, caused by the blockade of the NOx accumulator centres, and thus an increased forwarding of NO2 to the SCR system. The desulphurisation is carried out at high temperatures and rich exhaust gas composition.

For the conversion-optimised operation of the SCR system, depending on the deviation from the optimum of 50 percent of NO2/NOx and state of the nitrogen oxide accumulator catalytic converter 14, different measures can be adopted which benefit from the different influences of the factors, mentioned above, on the NO2/NOx ratio. Depending on the degree of ageing, the amount of NO2 lies above and below the optimum of 50 percent. In particular in the fresh state, the DOC-plus or the DOC provides too much NO2, which necessitates a targeted reduction of the NO2 formation. However, with increasing ageing, the level is clearly reduced and, in the aged state, calls for an enhanced NO2 provision by the DOC-plus or the DOC. The targeted regulation of the NO2/NOx ratio, also referred to as NO2/NOx amount, becomes possible as a result of switching different measures adjusted to one another for conditioning the nitrogen oxide accumulator catalytic converter 14, in particular based on the influential factors stated above.

In order to reduce the NO2/NOx ratio, different measures can be adopted on the nitrogen oxide accumulator catalytic converter 14. One possibility for reducing the NO2/NOx ratio can be the conscious approval of a defined poisoning state by HC. To do so, the point in time at which a regeneration request is carried out can be prolonged until reaching a predeterminable or predetermined lower threshold value. Thus, the emptying of the HC accumulator with accompanying improvement of the NO2 formation is only carried out later, whereby the NO2/NOx ratio overall reduces. In addition, the temperature increase taking place for the de-poisoning can be shortened from 7 seconds to 4 seconds by means of richness leap in comparison to the conditioning carried out as standard. As a result of this, the HC accumulator is not completely emptied via an active temperature increase; the remaining poisoning effect enables the reduction of the NO2 level while simultaneously maintaining the CO conversion. However, a thermal withdrawal of the HC, emerging as a result of the driving operation, cannot be influenced. The exertion of influence on the NO2/NOx ratio by means of HC poisoning is thus only possible in the range of low temperatures, above all below 300 degrees Celsius before the nitrogen oxide accumulator catalytic converter 14.

To lessen the NO2/NOx amount, further possibilities are available for the DOC-plus. The NOx accumulator amount can be specifically increased as an additional measure. In order to keep the NO2/NOx ratio, also referred to an NO2/NOx level, low, the amount of stored NOx can be kept low in such a way that the NO2 formation lies in the lower range of the optimum operating window. This is made possible as a result of a desulphurisation strategy, also referred to as DeNOx strategy, in which a regeneration requirement is already carried out by means of richness leap from about 40 percent of the NOx accumulator capability, while, for the standardly aged DOC-plus, this is only the case from about 60 percent NOx accumulator configuration.

The deactivation of the DOC-plus can be consciously held below the upper threshold in order to keep the NO2/NOx amount low in the fresh state. This is achieved by a richness leap duration of from 4 seconds to 5 seconds instead of from 6 seconds to 8 seconds or a reduction in the number of richness leaps. Amended trigger mechanisms for the richness activation are a further measure, whereby this is only carried out with great deactivation after falling below the lower threshold. For the fresh DOC-plus, a moderate NO2 formation emerges, and the NO2/NOx ratio can be kept in the region of the optimum of 50 percent.

Along with the NOx accumulator amount and the activity state, the poisoning with sulphur (S) can also be used as indirect influential parameter on the NO2 formation on the DOC-plus. If the NO2/NOx ratio is to be lowered in the fresh state, the amount of stored sulphur in the DOC-plus is kept as low as possible. To do so, on one hand, the time interval between the desulphurisations can be shortened, i.e., a desulphurisation request is already made when exceeding the lower boundary line. On the other hand, as a result of an increased amount of reductant, a complete removal of the sulphur is ensured during the desulphurisation. For the sulphur-free DOC-plus, NO2 is instead then used for the NOx storage, as a result of which the NO2/NOx ratio can also be lessened.

With increasing ageing, in order to maintain the SCR conversion, the conditioning of the nitrogen oxide accumulator catalytic converter 14 towards higher NO2/NOx ratios is necessary. The increase of the NO2 amount can be carried out as needed by a single measure or the combination of several measures. In opposition to the strategy with a high NO2/NOx ratio, in the aged state, an HC poisoning of the nitrogen oxide accumulator catalytic converter 14 is kept as low as possible. To do so, it is already poisoned with standard poisoning by means of temperature increase. Thus, even with a greatly aged system, an NO2/NOx level in the range of 50 percent can be maintained.

As a further measure, on the DOC-plus, the NOx accumulator configuration can be kept so high that the lower threshold value is not fallen below. Instead of regenerating when the NOx accumulator is 60 percent full, as is usual in the moderate state, the desulphurisation request can be prolonged up to an NOx accumulator configuration of from 80 percent to 90 percent. As a result of the high NOx accumulator configuration, the further storage of NOx decreases, which is why more NO2 can reach the SCR system from the DOC-plus.

In order to also achieve a sufficient NO2 formation in the greatly aged state of the DOC-plus, it is important to keep the activity state of the DOC-plus high. To do so, a longer richness leap duration of up to 10 seconds instead of the usual 6 seconds to 8 seconds is approved. Similarly, the richness leap depth can be increased depending on the ageing up to a lambda value of 0.9 instead of 0.95 in the standardly aged state, or more richness leaps are undertaken for the activation. In general, in the greatly aged state of the DOC-plus, the activation request is carried out earlier in order to not fall below the lower boundary. As a result of this, a high activation degree of the DOC-plus is ensured, which along with the NO2 formation, also supports the CO and the HC conversion in the aged catalytic converter state.

In addition, a conscious sulphur poisoning of the greatly aged DOC-plus is conceivable by the desulphurisation intervals being lengthened or the desulphurisation being carried out only incompletely. As a result of this, the NOx accumulator capability is lessened; however, for this, the NO2 formation is kept in the region of the lower threshold value. Thus, a higher NO2/NOx ratio is provided to the SCR system, which predominantly enables a better NOx total conversion.

Overall, it can be seen that, as a result of adjusted conditioning of the nitrogen oxide accumulator catalytic converter 14, a regulation of the NO2 formation can be carried out, which is used for conversion optimisation of the subsequent SCR system. For this, an NO2/NOx ratio of 50 percent is optimal, since the NOx conversion then instead ends via the quick SCR reaction. The NO2 formation on the nitrogen oxide accumulator catalytic converter 14 here significantly depends on the ageing state and on the operating temperature of the catalytic converter. For temperatures below 250 degrees Celsius in the nitrogen oxide accumulator catalytic converter 14, the NO2 formation can be controlled via the influence of the HC poisoning. When using a DOC-plus, along with the direct influence of the NOx conversion by NOx storages, further influential possibilities on the NO2 formation also emerge. These include the NOx accumulator configuration and the activity of the DOC-plus as well as its poisoning by or with sulphur. Depending on the ageing state or depending on the ageing of the nitrogen oxide accumulator catalytic converter 14, it is significant to raise or lower the NO2 level via the described measures. Overall, a clear optimisation of the SCR conversion can thus be achieved over the lifetime of the components.

LIST OF REFERENCE CHARACTERS

10 Exhaust gas system
12 Arrow
14 Nitrogen oxide accumulator catalytic converter
16 Particulate filter
18 SCR catalytic converter
20 Dosing device
T4 Temperature sensor
T5 Temperature sensor

The invention claimed is:

1. A method for desulphurising a nitrogen oxide accumulator catalytic converter of an exhaust gas system of an internal combustion engine, wherein the exhaust gas system further includes a selective catalytic reduction catalytic converter disposed downstream of the nitrogen oxide accumulator catalytic converter, comprising the steps of:

adjusting a desulphurisation strategy to an ageing of the nitrogen oxide accumulator catalytic converter such that respective time intervals which lie between two desulphurisation processes for desulphurising the nitrogen oxide accumulator catalytic converter become longer with increasing ageing of the nitrogen oxide accumulator catalytic converter, wherein the desulphurisation strategy is adjusted to the ageing of the nitrogen oxide accumulator catalytic converter such that respective desulphurisation temperatures, at which respective desulphurisation processes for desulphurising the nitrogen oxide accumulator catalytic converter are carried out, become lower with increasing ageing of the nitrogen oxide accumulator catalytic converter.

2. The method according to claim 1, wherein the nitrogen oxide accumulator catalytic converter has a cryogenic temperature accumulator capability and is an oxidation catalytic converter.

3. The method according to claim 1, wherein the desulphurisation strategy is adjusted to the ageing of the nitrogen oxide accumulator catalytic converter such that respective desulphurisation phases during a desulphurisation process for desulphurising the nitrogen oxide accumulator catalytic converter become shorter with increasing ageing of the nitrogen oxide accumulator catalytic converter.

4. The method according to claim 1, wherein the desulphurisation strategy is adjusted to the ageing of the nitrogen oxide accumulator catalytic converter such that a number of desulphurisation phases during a desulphurisation process for desulphurising the nitrogen oxide accumulator catalytic converter is reduced with increasing ageing of the nitrogen oxide accumulator catalytic converter.

5. The method according to claim 1, wherein the ageing of the nitrogen oxide accumulator catalytic converter is calculated on a basis of at least one calculation model by an electronic calculating device.

* * * * *